US006833037B1

(12) United States Patent
Hallam et al.

(10) Patent No.: US 6,833,037 B1
(45) Date of Patent: Dec. 21, 2004

(54) POLYMER BONDED ENERGETIC MATERIALS

(75) Inventors: Deirdre Hallam, Cumbran Gwent (GB); Ronald E. Hollands, Gwent (GB); Pauline J. Holes, Bedfordshire (GB)

(73) Assignee: BAE Systems PLC, London (GB)

( * ) Notice: Subject to any disclaimer, the term of this patent is extended or adjusted under 35 U.S.C. 154(b) by 1826 days.

(21) Appl. No.: 07/481,830

(22) Filed: Jan. 25, 1990

(30) Foreign Application Priority Data

Jan. 25, 1989 (GB) ..... 8901573

(51) Int. Cl.[7] ..... C06B 45/10
(52) U.S. Cl. ..... 149/19.91; 149/19.9
(58) Field of Search ..... 149/19.9, 19.91

(56) References Cited

U.S. PATENT DOCUMENTS 3,428,502 A * 2/1969 Evans ..... 149/19.9
3,702,354 A * 11/1972 Diebold et al. ..... 149/19.9
3,734,786 A * 5/1973 Walden et al. ..... 149/19.9
3,888,707 A * 6/1975 Rothenstein ..... 149/19.9
3,986,909 A * 10/1976 Macri ..... 149/19.9
4,090,894 A * 5/1978 Reed et al. ..... 149/19.91
H778 H * 5/1990 Carlton et al. ..... 149/19.4
4,952,255 A * 8/1990 Stanton ..... 149/19.91
5,009,728 A * 4/1991 Chan et al. ..... 149/19.9

* cited by examiner

*Primary Examiner*—Edward A. Miller
(74) *Attorney, Agent, or Firm*—Nixon & Vanderhye P.C.

(57) ABSTRACT

A thermoplastic bonded energetic material which comprises a composition which comprises:

Component A: an energetic filler material; and

Component B: a polymeric binder for the energetic filler material;

wherein the ratio of the weight of Component A present to the weight of Component B present in the composition is in the inclusive range from 1:10 to 1991:1 and wherein Component B comprises an intimate mixture of Ingredients 1 and 2 as follows:

Ingredient 1: a copolymer of ethylene and vinyl acetate;

Ingredient 2: a copolymer of butadiene and acrylonitrile; the ratio of the weight of Ingredient 1 present to the weight of Ingredient 2 present in Component B being in the inclusive range from 1:10 to 10:1.

18 Claims, No Drawings

POLYMER BONDED ENERGETIC MATERIALS

The present invention relates to polymer bonded energetic materials.

Polymer bonded energetic materials comprising an energetic filler material, usually in the form of a solid crystalline powder, formed into a consolidated mass having suitable mechanical properties and insensitivity by a polymeric binder are well known and are used in a variety of military and civilian applications. Such materials in various compositions are used for example as high explosives for use in demolition, welding, detonating, cutting charges and munition fillings, as propellants for guns and rockets, as gas generators and as pyrotechnics.

Binders used in polymer bonded energetic materials need to be (amongst other things) compatible with the other ingredients of the material and suitably processed together with the other ingredients into the appropriate shapes required in the various applications.

Polymeric binders may be classified generally into chemically cured materials and thermoplastic materials. Chemically cured materials, eg. thermosetting resins, rely on the chemical reaction between different components to provide the desired polymeric structure.

The reacting components are normally brought together during manufacture of the end product material, eg. when the material is shaped, eg. cast, moulded or extruded. The cure time can be lengthy, and hence costly, and it can be difficult to control the chemical reaction involved.

Thermoplastic binders allow energetic materials containing them to be processed at elevated temperatures, usually outside the in-service envelope of the end product, but cool to give dimensionally stable sheet, bars, cylinders and other shapes. Shaping of the end product relies on purely physical changes taking place in the binder of the material. Reject materials may be re-cycled by re-heating. This may not normally be achieved with materials based on chemically cured binders.

The use of thermoplastic binders in known energetic materials has shown disadvantages in each case.

For example, a known material described in UK Patent No.1,082,641 herein called "Composition A" comprising RDX (1,3,5-cyclotrimethylene-2,4,6-trinitramine) as energetic filler and a mixture of polyisobutylene, di-(2-ethylhexyl)sebacate and polytetrafluoroethylene as thermoplastic binder is used as a conventional service material in a number of military applications as a plastic bonded high explosive but this material suffers from the problems (a) that it is difficult to shape under pressure, eg by extrusion, (b) when rolled into sheets it has anisotropic properties, and (c) when deformed it has little elastic memory to regain its original shape.

It is known to produce polymer bonded energetic materials such as solid explosives and propellants using an ethylene-vinyl acetate (EVA) copolymer as a thermoplastic binder. UK Patent Specification No.1,554,636 describes for use in explosive compositions EVA copolymers which are mixed with a plasticiser in order to reduce the temperatures at which the binder may be processed.

We have discovered however that EVA copolymers modified in the manner described in UKP 1,554,636 are not ideal in a number of respects, particularly as regards their mechanical properties, for use in polymer bonded energetic materials such as explosives.

It is the purpose of the present invention to provide a novel thermoplastic polymer bonded energetic material in which the polymer binder is specially selected to overcome the problems shown in the prior art by known thermoplastic polymer bonded energetic materials.

According to the present invention a thermoplastic polymer bonded energetic material comprises a composition which comprises:

Component A: an energetic filler material; and

Component B: a polymeric binder for the energetic filler material;

wherein the ratio of the weight of Component A present to the weight of Component B present in the composition is in the inclusive range from 1:10 to 199:1 and wherein Component B comprises an intimate mixture of Ingredients 1 and 2 as follows:

Ingredient 1: a copolymer of ethylene and vinyl acetate;

Ingredient 2: a copolymer of butadiene and acrylonitrile; the ratio of the weight of Ingredient 1 present to the weight of Ingredient 2 present in Component B being in the inclusive range from 1:10 to 10:1.

Ingredients 1 and 2 will be referred to herein as "EVA" and "BN" respectively. The terms "EVIA" and "BN" will herein be understood to include compounds in which other units are optionally copolymerised with the ethylene and vinyl acetate units on the one hand and the butadiene and acrylonitrile units on the other hand. These terms will also be understood to include coplymers containing optional substituents, eg. halides or methyl groupings, in the ethylene, vinyl acetate, butadiene and acrylonitrile units.

Preferably, the softening point of Component B is greater than 60° C. desirably greater than 80° C.

Preferably, the BN per se (prior to introduction to the other components) is in the form of a liquid having a viscosity greater than 50 cst when measured at a temperature of 20° C. and a molecular weight in the range 200 to 20,000, desirably in the inclusive range 2000 to 5000. Such a compound may be modified in the course of processing to form a product.

The material according to the present invention may, for example, be in the form of a consolidated rubbery mass, the energetic filler Component A preferably being a particulate, eg. powdered, solid, being embedded in the binder Component B.

The polymer bonded energetic materials according to the present invention give mechanical properties superior to those of the prior art materials described in UKP 1,554,636. The plasticisers employed in the polymer bonded explosive compositions described in UKP 1,554,636 are generally non-viscous mobile liquids of viscosity less than 50 cst, typically 10 cst at 20° C. which can exude from the compositions containing them during temperature cycling in storage or use. This causes the composition to become brittle with age. Furthermore, the said plasticisers do not give satisfactory adhesion to the explosive material and this can result in useless crumbly material at some plasticiser concentrations.

In contrast, the BN polymers employed in the compositions according to the present invention to plasticise the EVA do not substantially migrate during storage or use and give good adhesion to the energetic filler material as well as to the EVA and this provides compositions having improved physical, mechanical and ageing properties.

The materials according to the present invention can show improvements over the materials of UKP 1,082,641 in that they have properties which are substantially isotropic and may be formed more easily into desired shapes, such as by rolling, pressing, moulding, extruding or casting, which can retain their elastic memory and repair their shape when deformed.

In Component B of the materials according to the present invention, optional additives may be included in the mixture together, with EVA and BN. Examples of such additives include plasticisers and antioxidants. Examples of suitable optional additives are given hereinafter.

Preferably, the optional additives will comprise in total not more than 20 percent by weight, normally less than 10 percent by weight, of Component B.

Component B may comprise from 25 to 85, preferably 50 to 75 percent, by weight EVA and from 20 to 60, preferably 25 to 50, percent weight BN.

The EVA present in Component B may have a vinyl acetate content of from 25 percent to 75 percent, desirably from 33 to 60 percent inclusive, especially 40 to 45 percent inclusive. This polymer may be provided in the form of a mixture of different EVA compounds having different vinyl acetate contents.

An EVA copolymer containing 45 percent by weight vinyl acetate has been shown to provide a particularly satisfactory example.

The BN present in Component B may have a bound acrylonitrile content in the inclusive range 5 to 50 percent by weight, desirably in the inclusive range 10 to 30 percent by weight. The BN polymer contained in component B may be provided by a mixture of different BN compounds, eg. having a different acrylonitrile content.

The BN polymer or polymers included in Component B may have functional terminations. For example, these polymers may be carboxyl terminated, hydroxy terminated, amino terminated or vinyl terminated. Alternatively, the polymer may be non-functionally terminated.

Polymers comprising acrylonitrile/carboxyl terminated butadienes may include as copolymerised monomer units optionally substituted alkyl chains, eg. dimethylene optionally substituted with a carboxyl group.

Carboxyl terminated acrylonitrile/butadiene having a bound acrylonitrile content of 26 percent, a bound butadiene content of 74 percent by weight and a molecular weight of 3200 has been found to provide a particularly satisfactory example.

The energetic filler and the relative proportions of the components of the energetic material will, as will be appreciated by those versed in the art, depend upon the type of application for which the material is to be used.

The energetic material according to the present invention may for example comprise a plastic bonded explosive in which the binder forms between 0.5 and 30 percent by weight and the energetic filler forms between 99.5 and 70 percent by weight. Examples of energetic fillers which may be incorporated in such materials include organic secondary explosives. Alicylclic nitramines such as RDX (1,3,5-cyclotrimethylene-2,4,6,-trinitramine) and HMX (1,3,5,7-cyclotetramethylene-2,4,6,8-tetranitramine) and TATND (tetranitro-tetraminodecalin) and mixtures thereof are preferred for use as such organic fillers but the following highly energetic organic fillers may also be used as the main or as a subsidiary energetic component in plastic bonded explosives: nitroguanidine, aromatic nitramines such as tetryl, ethylene dinitramine, nitrate esters such as nitroglycerine, butanetriol trinitrate and PETN (pentaerythritol tetranitrate). Other nitroaromatic compounds such as trinitrotoluene (TNT) triaminobenzene (TATB) triaminotrinitro benzene (TATNB) and hexanitrostilbene may also be used. Alternatively inorganic fillers such as ammonium nitrate and alkaline earth metal salts provide suitable high explosive materials. Metallic fuels such as powdered aluminium, magnesium or zirconium may be used to fuel the exothermic reaction of the oxidation of the energetic material. The metallic fuel may comprise up to 50 percent by weight of the energetic filler.

The energetic materials according to the present invention may alternatively comprise a gun propellant. In such a material the content of the energetic filler is generally in the range 70 to 90 percent by weight of the binder/filler mixture and may be selected for example from nitroglycerine, RDX and HMX or a combination thereof, optionally with other highly energetic fillers such as those listed above. The binder of such a material may comprise in addition to the blend specified above a cellulosic material eg. nitrocellulose eg. forming from 5 to 95 percent, eg. 30 to 70 percent by weight of the binder.

The energetic material according to the present invention may alternatively comprise a gas generator material eg. for power cartridges for actuators: for base burning, reduced base drag, extended range projectiles: and for control gas jets for missile and projectile guidance systems and the like. Such material is similar in nature to a propellant, but in general contains a lower content of energetic filler, eg. 45% to 65% by weight energetic filler optionally together with a surface burning rate inhibitor, eg. ethyl cellulose.

As an example of a suitable rocket propellant embodying the invention the propellant composition may include as energetic filler ammonium perchlorate (20 to 90 percent by weight of the energetic filler) together with aluminium as fuel (5 to 50 percent by weight of its mixture with energetic filler), the binder forming for example 5 to 30 percent by weight of the composition.

The energetic material according to the present invention may also comprise a polymer bonded pyrotechnic material, eg. containing an inorganic nitrate or perchlorate of ammonium, barium or strontium (forming 20 to 80 percent by weight of the energetic filler), a metallic fuel such as magnesium or zirconium (forming 5 to 60 per cent by weight of the filler), the binder comprising 5 to 30 percent by weight of the overall composition.

Although the use of non-viscous plasticisers may be avoided by use of the polymer bonded energetic materials according to the present invention because the BN polymers have a plasticising effect upon the EVA, non-viscous plasticisers may optionally be incorporated in low concentrations in the compositions according to the present invention, eg. preferably less than 10 percent by weight of the binder formed by addition to Component B eg. to improve binder processibility.

For example, common plasticisers which are dialkyl esters of phthalic, adipic and sebacic acids may be used as the optional plasticiser, eg. the plasticiser may comprise dibutyl phthalate, disobutyl phthalate, dimethyl glycol phthalate, dioctyl adipate or dioctyl sebacate.

In addition, or alternatively, energetic plasticisers such as GAP (glycidyl azide polymer), BDNPA/F (bis-2-dinitropropylacetral/formal), bis-(2-fluoro-2, 2-dinitroethyl) formal, diethylene glycol dinitrate, glycerol trinitrate, glycol trinitrate, triethylene glycerol dinitrate, trimethylolethane trinitrate butanetriol trinitrate, or 1,2,4-butanetriol trinitrate, may be employed in concentration less than 10 percent by weight of binder formed by addition to Component B in the materials according to the present invention.

In the material according to the present invention other binder polymers may be blended with the composition provided by Component B in a concentration of up to 45 percent by weight, preferably less than 20 percent by weight of the overall binder content formed by the addition. The additional binder polymer(s) may comprise an inert binder material, an energetic binder material or a blend of inert and energetic binder materials.

Examples of suitable additional inert or non-energetic binder materials are cellulosic materials such as the esters, eg. cellulose acetate, cellulose acetate butyrate, and synthetic polymers such as polyurethanes, polyesters, polybutadienes, polyethylenes, polyvinyl acetate and blends and/or copolymers thereof.

Examples of suitable energetic binder materials are nitrocellulose, polyvinyl nitrate, nitroethylene, nitroallyl acetate, nitroethyl acrylate, nitroethyl methacrylate, trinitroethyl acrylate, dinitropropyl acrylate, C-nitropolystyrene and its derivatives, polyurethanes with aliphatic C- and N-nitro groups, polyesters made from dinitrocarboxylic acids and dinitrotrodiols and nitrated polybutadienes.

We prefer for use as additional binders especially where the material is a propellant or gas generator charge material, cellulosic materials, comprising 100 to 40 percent by weight of nitrocellulose and 10 to 60 percent by weight of an inert cellulose ester eg. cellulose acetate or cellulose acetate butyrate.

Extenders may be used as part of the binder formulation to improve the processibility and flexibility of the product. For example, heavy grade liquid paraffin (up to 3 percent by weight of the binder formulation) may be employed in the binder.

Various known minor additives may be added to the materials according to the present invention. Preferably, the additives content comprises no more than 10 percent by weight, desirably less than 5 percent by weight, of the overall energetic material composition.

For example in propellant and gas generator compositions the additive may for example comprise one or more stabilisers, eg. carbamite or PNMA (para-nitromethylaniline); and/or one or more ballistic modifiers, eg. carbon black or lead salts; and/or one or more flash suppressants, eg. one or more sodium or potassium salts, eg. sodium or potassium sulphate or bicarbonate.

Antioxidant in an extent of up to 1 percent by weight of the overall composition of the energetic materials may usefully be incorporate in the materials. A suitable antioxidant has been found to be 2,2'-methylene-bis(4-methyl-6-butyl)phenol.

Coupling agents known per se, eg. in concentrations of up to 2 percent by weight of the overall composition weight, may be employed to improved adhesion between the binder and energetic filler components (Components A and B) in the materials according to the present invention.

Preferably, where the energetic material according to the present invention is a plastic bonded explosive it contains the following components (in percentage parts by weight):

RDX: 80–99.5 percent, preferably about 88 percent;

binder: 20–0.5 percent, preferably about 12 percent;

Preferably the binder comprises 60 to 75 percent EVA (preferably at least 25 percent of which is a polymer having a 45% by weight vinyl acetate content); 25 to 50 percent BN, and 0 to 1 percent antioxidant, the overall percentages (excluding further optional additives) adding to 100 in each case.

Compositions which are materials according to the present invention may be processed into manufactured products by processes which are generally known per se. For example, for the manufacture of plastic bonded explosives the binder ingredients may be added and mixed together in a blender at temperatures of 80° C. to 140° C. and then added to the energetic filler by a solventless process or a solvent lacquer process.

In a solvent lacquer process, for example, the binder is dissolved in an organic solvent at a moderately elevated temperature, eg. 40° C. to 80° C. and the energetic filler is subsequently stirred into the solvent lacquer after cooling to about 20° C. to give a slurry. The slurry is then mixed under vacuum at an elevated temperature, eg. 50° C. to 90° C., preferably 75° C. to 90° C. In a solventless process for example, for the production of plastic bonded nitramines the required quantity of pre-dried energetic filler material is wetted with water or an aqueous solution and heated to an elevated temperature, eg. 80° C.–100° C. The binder is then added to the energetic filler and the components are mixed together at that temperature. Any water remaining in the composition is removed under vacuum. Materials produced by these different routes give no discernible difference in properties.

Materials produced in the ways described above or in other known ways may, depending on the material composition and its intended use, may be shaped into products in known ways. For example, the material may be pressed, moulded or cast into a desired shape eg. for use as blocks, sheet explosive or for filling of shells, warheads and the like. Alternatively, the material may be extruded in a known manner in a corotating twin screw extruder, and subsequently cooled. The latter technique is especially suitable for the manufacture of gun propellant materials, eg. stick or tubular propellants of known cross-sectional shape.

In summary, the energetic materials of the present invention may depending upon their specific composition and properties be used in any one or more of the following well known applications:

(i) General demolition;
(ii) Explosive welding;
(iii) Active armour;
(iv) Detonating cord;
(v) Linear cutting charges;
(vi) Shell fillings;
(vii) Mine fillings;
(viii) Grenade fillings;
(ix) Shaped-charge warhead fillings;
(x) Fragmentation warhead fillings;
(xi) Booster pellets;
(xii) Peripheral initiation and detonation transfer systems;
(xiii) Gun propellants;
(xiv) Rocket propellants;
(xv) Gas generators;
(xvi) Pyrotechnics;

Examples of the production and properties of polymer bonded energetic materials embodying the present invention will now be described Examples of thermoplastic binder compositions comprising Component B specified above for use in energetic materials embodying the present invention were prepared by Method A as follows:

Method A

Into an incorporator (mixer) pre-heated to a temperature of 95° C. were placed the required quantities of binder ingredients to give the appropriate binder proportions by weight in the final product. Mixing was then begun. During mixing the incorporator was evacuated to de-aerate the composition being formed. Mixing was applied for about 30 minutes after which it was stopped again to allow the blades of the incorporator to be scraped. Mixing was continued for another 90 minutes after which it was stopped and the incorporator cooled to 60° C. The mixed binder was then removed from the incorporator and stored in suitable containers.

Binder compositions prepared by Method A were employed, together with energetic filler comprising RDX, to provide plastic bonded explosive materials embodying the present invention by the following method, Method B.

Method B

Pre-dried and weighed RDX in powdered form was mixed in a suitable mixer with 30% w/w water to provide water-wet RDX paste. The required weight of binder composition was placed into an incorporator pre-heated to 95° C. followed by the required weight of RDX paste to give the required product composition. The contents of the incorporator were mixed for 15 minutes after which the mixing was stopped and the blades and sides were scraped. Mixing was continued for a further 90 minutes with further stopping and scraping at 30 minute intervals. After mixing for 105 minutes in total the explosive composition was removed from the incorporator in a hot flowable form. It could be stored in bulk by transfer to a storage container and subsequent cooling or used immediately to be formed into desired shapes, eg. by pressing, casting, rolling, extruding or moulding as appropriate, followed by cooling and storing.

A variety of binder compositions were prepared by Method A using commercially available ingredients whose properties are summarised as follows:

EVA Polymers

The copolymers employed were the commercially available materials supplied by the following companies under the trade designations quoted as follows:

| | |
|---|---|
| Elvax 40-W | Du Pont Co. |
| Escorene Ultra 05540CC | Esso Chemical Co. |
| Evatane 33-25 | Ato Chemie |
| Levapren 450P(N) | Bayer |

The properties of these polymers are summarised in Table 1 as follows.

Except as indicated in Table 1 by the superscripts a to i, properties (2) to (7) were measured by known standard methods designated respectively as follows:

Property ASTM No.

(2) D1505
(3) 1238
(4) E38
(5) 2240
(6) D638
(7) D638

Superscripts e to j in Table 1 indicate the following measurement conditions:

e : 23° C.
f: ASTM D792
g: DIN 53479
h: ASTM D1708
i: DIN 53504
j: ASTM 1708 DIN

CTBN Copolymers

Carboxyl terminated butadiene/acrylonitrile (CTBN) copolymers employed in Method A were selected from the series supplied commercially by GF Goodrich Co. under the trade mark Hycar with the following specific designations:

1300X8, 1300X9, 1300X13, 1300X15, 1312

These copolymers may be represented by the structural formulae given in Table 2 as follows:

TABLE 1

PROPERTIES OF EVA COPOLYMERS

| PROPERTY | ELVAX 40-W | ESCORENE ULTRA 05540CC | EVATENE 33-25 | LEVAPREN 450P(N) |
|---|---|---|---|---|
| (1) Vinyl Acetate Content (% w/w) | 40 | 40 | 33 | 45 +/− 1.5 |
| (2) Density (g/cm$^3$) | 0.965$^e$ | 0.960$^f$ | 0.96 | 0.98$^g$ |
| (3) Melt Flow Index (g/10 min) | 57 | 55 | 25 | 2.5 +/− 1.5 |
| (4) Softening Point (Ring and Ball) (° C.) | 104 | | 110 | |
| (5) Shore Hardness A (20° C.) | 40 | 55 | 70 | 30–36 |
| (6) Tensile Strength (MPa) | 4.8–6.2$^h$ | >5.85 | | 1.5–3.0$^i$ |
| (7) Elongation at Break (%) | 1000–1300J | >1000 | 800–1000 | >1,100$^i$ |

TABLE 2

FORMULAE OF SELECTED HYCAR CTBN LIQUID POLYMERS

| Formula | Hycar CTBN Copolymer Designation |
|---|---|
| $HOOC-[(CH_2-CH=CH-CH_2)_x-(CH_2-CH)_y]_m-COOH$ (C=N) | 1300X15<br>1300X8<br>1300X13 |
| $HOOC-[(CH_2-CH=CH-CH_2)_x-(CH_2CH)_y-(CH2-CH)_z]_m-COOH$ (C=N; COOH) | 13009 |

In Table 2, m=7 and the percentage by weight of bound acrylonitrile (ie. 100×ratio of y:x per unit of x+y) for each copolymer is as follows:

| Hycar Designation | Bound Acrylonitrile content |
|---|---|
| 1300X15 | 10% |
| 1300X8 | 18% |
| 1300X13 | 26% |
| 1300X9 | 18% |

Table 3 as follows gives various known properties of the CTBN copolymers specified above.

TABLE 3

SOME PROPERTIES OF SELECTED HYCAR (TRADE MARK) BUTADIENE-ACRYLONTRILE COPOLYMERS

| | Hycar Butadiene-Acrylonitrile Copolymer Grade | | | | |
|---|---|---|---|---|---|
| Property | CTBN 1300X8 | CTBN 1300X9 | CTBN 1300X13 | CTBN 1300X15 | 1312 |
| Acrylonitrile Content (%) | 18 | 18 | 26 | 10 | |
| Carboxyl Content Acid No | 29 | 38 | 32 | | — |
| EPHR | 0.052 | 0.067 | 0.057 | 0.054 | — |
| Bookfield Viscosity (mPas or cP.27° C.) | 135,000 | 160,000 | 570,000 | 65,000 | 100,000[c] |
| Solubility Parameter (based on molar attraction constants) | 8.77 | — | 9.14 | | — |
| Specific Gravity 25° C. | 0.948 | 0.955 | 0.960 | 0.924 | 0.96 |
| Functionality | 1.8 | 2.4 | 1.8 | | — |
| Molecular Weight (Mn) | 3,600 | 3,600 | 3,200 | | |

[b]Not functionally terminated.

[c]At 30° C.

Antioxidant

Antioxidant was employed as a binder ingredient in some examples of binders made by Method A. The compound 2,2-methylene-bis (4-methyl-6-butyl)phenol was used as this antioxidant.

Binder Compositions

Examples of binder compositions using ingredients selected from the EVA copolymers CTBN copolymers and antioxidant specified above which were made by Method A are specified in Table 4 as follows:

TABLE 4

THERMOPLASTIC BINDER COMPOSITIONS

| Binder Number | EVA (% w/w) LEVAPREN 450 | ELVAX 40 W | EVATENE 33-25 | CTBN (% w/w) HYCAR 1300X15 | HYCAR 1300X13 | HYCAR 1312 | Antioxidant (% /w) |
|---|---|---|---|---|---|---|---|
| B1 | — | 50 | — | — | 50 | — | — |
| B2 | — | 66.67 | — | — | 33.33 | — | — |
| B3 | — | 75 | — | — | 25 | — | — |
| B4 | — | — | 66.67 | — | 33.33 | — | — |
| B5 | 66.67 | — | — | — | 33.33 | — | — |
| B6 | — | 50 | 16.67 | — | 31.67 | — | 1.66 |
| B7 | — | 70 | — | — | 29.50 | — | 0.50 |
| B8 | — | 60 | — | — | 39.50 | — | 0.50 |
| B9 | 20 | 40 | — | — | 49.75 | — | 0.50 |
| B10 | 20 | 30 | — | — | 39.75 | — | 0.25 |
| B11 | 10 | 50 | — | — | 39.75 | — | 0.25 |
| B12 | 15 | 45 | — | — | — | 39.75 | 0.25 |
| B13 | 15 | 45 | — | — | — | — | 0.25 |
| B14 | 15 | 45 | — | 39.75 | — | — | 0.25 |
| B15 | 16 | 54 | — | 29.85 | — | — | 0.15 |
| B16 | 60 | — | — | 39.75 | — | — | 0.25 |
| B17 | 60 | — | — | 39.50 | — | — | 0.50 |
| B18 | 55 | — | — | 44.75 | — | — | 0.25 |
| B19 | 55 | — | — | 44.50 | — | — | 0.50 |
| B20 | 65 | — | — | 34.75 | — | — | 0.25 |
| B21 | 65 | — | — | 34.50 | — | — | 0.50 |

Examples of properties of the binders specified in Table 4 are given in Table 5 as follows:

TABLE 5

THERMOPLASTIC BINDER PROPERTIES

| Binder Reference Number | Softening Point (° C.) |
|---|---|
| B1 | 67.5 |
| B2 | 78.0 |
| B3 | 82.0 |
| B4 | 88.0 |
| B5 | 127.5 |
| B6 | 79.0 |
| B7 | 79.0 |
| B8 | 72.5 |
| B9 | 90.0 |
| B10 | 78.5 |
| B11 | 76.5 |
| B12 | 84.0 |
| B14 | 69.0 |
| B15 | 73.0 |
| B16 | 84.0 |
| B17 | 84.0 |
| B18 | 80.0 |
| B19 | 80.0 |
| B20 | 90.5 |

In Table 4 the softening point was measured by the known standard Ring and Ball Method described in ASTM D36-84.

Examples of explosive compositions embodying the present invention which were made by Method B given hereinbefore using binder compositions specified in Table 4 are summarised in Table 6 as follows:

TABLE 6

EXPLOSIVE FORMULATIONS EMPLOYING THERMOPLASTIC BINDERS

| Formulation Reference | Binder Reference Number | Solids Loading (% w/w) |
|---|---|---|
| E1 | B7 | 88 |
| E2 | B8 | 88 |
| E3 | B8 | 88 |
| E4 | B11 | 88 |
| E5 | B12 | 88 |
| E6 | B12 | 88 |
| E7 | B12 | 88 |
| E8 | B12 | 86 |
| E9 | B14 | 88 |
| E10 | B16 | 88 |
| E11 | B16 | 88 |
| E12 | B18 | 88 |
| E13 | B19 | 88 |
| E14 | B21 | 88 |
| E15 | B16 | 88 |
| E16 | B18 | 88 |
| E17 | B20 | 88 |
| E18 | B17 | 88 |
| E19 | B16 | 88 |
| E20 | B18 | 89 |
| E21 | B18 | 90 |
| E22 | B18 | 91 |

In Table 6 the solids loading comprises the RDX content the remainder of the final composition comprising the binder as specified in each case.

As an example of the use of the various compositions specified in Table 5, the various compositions have been fabricated by extrusion at temperatures between 80° C. and 100° C. into various shapes such as bars, cords and chevrons. Such extrusion is generally easier than using prior art Composition A specified above. The compositions specified in Table 6 have also been rolled in sheet form and have been found to be suitably bendable at 25° C., 60° C. and 80° C. showing substantial isotropy in mechanical properties and substantial reattainment of original shape after deformation (in contrast to Composition A as described above).

As an example of the variation of mechanical properties as between the specific compositions specified in Table 6, E21 has been found to give the most flexible softest sheet, whilst E22 has been found to give the least flexible toughest sheet. The other examples show mechanical properties between these two extremes.

All of the compositions specified in Table 6 show in sheet form a powder insensitiveness and shock sensitivity equivalent to or better than that of the prior art Composition A specified above (conventionally used in sheet explosive materials).

To illustrate further the beneficial aspects of the present invention, a comparison was made of the physical properties of binders and explosive materials described respectively herein and in UKP 1,554,636.

Three candidate explosive compositions were selected to represent the range of properties obtainable from formulations embodying the present invention described herein, namely E13, E14 and E18 defined hereinbefore. Explosives based on the prior art class of materials described in UK Patent Specification No.1,554,636 were also manufactured. Formulations plasticised with DOA, DOS and DMCP (as defined hereinafter) were used as prior art materials for the comparison as these demonstrated the best physical properties obtainable from materials described in UKP 1,554,636.

A number of tests were conducted first to compare the physical properties of inert binders. Compositions are as detailed in Table 7 hereinafter. The composition specified in Table 7 as DNB2 exhibited the best physical properties of inert binders based on the class of materials disclosed in UKP 1,554,636 which were used in this assessment.

TABLE 7

BINDER COMPOSITIONS

| BINDER REF | EVA-LEVAPREN 450P % w/w | OTHER INGREDIENTS | PLASTICIZER (PL) | % w/w PL | RELATED EXPLOSIVE COMPOSITIONS |
|---|---|---|---|---|---|
| B17 | 60 | As in Table 4 hereinbefore | | | PRESENT INVENTION |
| B19 | 55 | As in Table 4 hereinbefore | | | PRESENT INVENTION |
| B21 | 65 | As in Table 4 hereinbefore | | | PRESENT INVENTION |
| DNB1 | 67 | | Dioctyl Adipate (DOA) | 33 | PRIOR ART UKP 1,554,636 |
| DNB2 | 67 | | Dioctyl Sebacate (DOS) | 33 | PRIOR ART UKP 1,554,636 |
| DNB3 | 67 | | Dimethyl Glycol Phthalate (DMGP) | 33 | PRIOR ART UKP 1,554,636 |

Physical properties of the binders listed in Table 7 are of course reflected in the explosive compositions employing them. Explosive compositions should be processible at a convenient temperature, but remain dimensionally stable within the service operating temperature range. They should be durable and resilient, exhibiting appropriate strength, extensibility and flexibility. Table 8 hereinafter illustrates the change in physical characteristics of the respective binders with temperature change.

TABLE 8

COMPARISION OF BINDER PROPERTIES WITH TEMPERATURE CHANGE

| BINDER REF | RING & BALL SOFTENING POINT[a] ° C. | CONE PENETRATION[b] MM/10 AT TEMP STATED (° C.) | | | | | | | | |
|---|---|---|---|---|---|---|---|---|---|---|
| | | −25 | 0 | 10 | 25 | 40 | 50 | 60 | 70 | 80 |
| B17 | 83 | 6 | 17 | 22 | 34 | 69 | 117 | 165 | 202 | 221 |
| B19 | 70 | 6 | 25 | 30 | 45 | 101 | 169 | 223 | 255 | 258 |
| B21 | 85 | 5 | 17 | 23 | 34 | 72 | 119 | 171 | 191 | 243 |
| DNB1 | 76 | 12 | 29 | 48 | 103 | 206 | >260 | >260 | >260 | >260 |

TABLE 8-continued

COMPARISION OF BINDER PROPERTIES WITH TEMPERATURE CHANGE

| BINDER REF | RING & BALL SOFTENING POINT[a] ° C. | CONE PENETRATION[b] MM/10 AT TEMP STATED (° C.) −25 | 0 | 10 | 25 | 40 | 50 | 60 | 70 | 80 |
|---|---|---|---|---|---|---|---|---|---|---|
| DNB2 | 78 | 14 | 32 | 52 | 105 | 200 | 236 | >260 | >260 | >260 |
| DNB3 | 87 | 10 | 17 | 27 | 53 | 106 | 169 | 205 | 223 | >260 |

[a]Ring and ball softening point, measured according to ASTM D36-84. Heating medium: water.
[b]Cone penetration, measured according to ASTM D2884-82 under the following conditions: cone and shaft weight = 193 g: 20° cone: 30 sec drop interval; temperature as stated; maximum possible penetration with samples used is 260 mm/10.

As seen from Table 8 at 25° C. compositions DNB1 and DNB2 are markedly softer than binders relating to those used in compositions embodying the present invention. The former tend to be slaccid, lacking the rubberiness and elasticity of the latter. DNB3 has a reasonable comparative cone penetration, but is subject to excessive exudation of the DMGP plasticiser, even at ambient temperatures, and is very tacky. As temperature increases, the prior art candidate materials soften rapidly, beginning to lose dimensional stability at a temperature of approximately 40° C. Even DNB3, the firmest prior art candidate material examined demonstrates a steep increase in cone penetration. Its softening characteristics are similar to those of B19. However, although its softness at ambient temperature is a drawback B19 was specifically selected for its excellent flexibility. DNB3 is neither flexible nor very elastic, and as aforementioned, exhibits considerable exudation. B17 and B21 remain firm and elastic to a high temperature, retaining excellent flexible rubbery properties.

A comparison of tensile properties is given in Table 9 hereinafter.

TABLE 9

COMPARISON OF BINDER TENSILE PROPERTIES

| BINDER REF | TENSILE PROPERTIES TEMPERATURE 23° C. ELONGATION AT BREAK % | TENSILE STRENGTH kPa | TEMPERATURE 0° C. ELONGATION AT BREAK % | TENSILE STRENGTH kPa |
|---|---|---|---|---|
| B17 | >1000 | 570 | >600 | 1880 |
| B19 | >1000 | 360 | >600 | 1470 |
| B21 | >1000 | 530 | >600 | 1590 |
| DNB 1 | >1000 | 180 | >600 | 1180 |
| DNB 2 | >1000 | 190 | >600 | 1260 |
| DNB 3 | >1000 | 620 | >600 | 2190 |

The measurements in Table 9 were made according to BS 903 Part A2; The measurement temperature is as stated.

Table 9 illustrates that at typical working temperatures inert binder compositions as used in the explosive compositions embodying the present invention show significantly higher tensile strength whilst retaining high extensibility compared with the binders of the prior art materials. The technique used is unable to quantify extensibility beyond a specific elongation (the limit depends on temperature) but qualitative tests show that inert binders as used in the compositions of the present invention are more flexible than those of UKP 1,554,636 at temperatures of 0° C. to 80° C. Prior art binder DNB3 is the exception, having the highest tensile strength at ambient temperature and retaining good extensibility. It is, however, relatively inflexible and its use is restricted by its excessive plasticiser exudation.

The weight loss over an ageing period of 6 months of binders used in conjunction with compositions embodying the present invention was compared with those of binders of the type used in UKP 1,554,636 compositions. The comparative weight loss was measured at elevated temperatures and results are given in Table 10. This illustrates that some of the binders of UKP 1,554, 636 materials exhibit a significantly greater weight loss owing to exudation of liquid ingredients.

TABLE 10

COMPARISON OF AGEING CHARACTERISTICS
Duration of Trial - 6 Months

| BINDER REF | WEIGHT LOSS % AFTER AGEING AT 25° C. | 60° C. | 80° C. |
|---|---|---|---|
| B17 | 0 | 0.38 | 0.67 |
| B19 | 0.10 | 0.37 | 0.82 |
| B21 | 0.02 | 0.32 | 0.72 |
| DNB1 | 0 | 0.78 | 4.30 |
| DNB3 | 0.12 | 3.52 | 11.64 |

An average of 2 samples of each material war investigated in each case in the investigations summarised in Table 10. Each of the samples was conditioned at 25° C. for 1 hour before weighing.

Of the binder materials in the class of compositions of UKP 1,554,636, the binder DNB2 offers the best compromise of tensile strength, extensibility, and flexibility over a wide temperature range. However, it exhibits a lower softening point than binders used in the compositions of the present invention arid tends to lose dimensional stability at too low a temperature.

In addition, binders used in materials embodying the present invention exhibit greater tensile strength card extensibility.

The quality of the energetic product eg. explosive composition employing a given binder determines conclusively the relative merit of a given type of binder. Examinations of explosive compositions employing the binders tested as described and listed in Tables 7 to 10 demonstrates the superior properties of those employed in compositions embodying the present invention for the applications. Such compositions are required as listed above. Comparative explosive compositions are detailed as examples in Table 11 as follows:

TABLE 11

| EXPLOSIVE COMPOSITIONS | | |
|---|---|---|
| EXPLOSIVE REF | BINDER (12% w/w) | RDX % w/w |
| E13[a] | B19 | 88 |
| E14[a] | B21 | 88 |
| E18[a] | B17 | 88 |
| DNE 1[b] | DNB1 | 88 |
| DNE 2[b] | DNB2 | 88 |
| DNE 3[b] | DNB3 | 88 |

[a]Candidate explosive formulations embodying the present invention.
[b]Candidate explosive formulations based on the prior art disclosure in UK Patent No. 1,554,636.

It should be noted that an RDX loading of 88% w/w loading was used in the candidate explosives. This respresents a standard solids loading of explosives required for applications for which the present invention is useful as described above. The maximum solids loading specified in UKP 1,554,636 is 85% w/w; the candidate explosives are not strictly disclosed in the Patent Specification of UKP 1,554,636 as they could be made with a solids loading of 88 percent. However, the candidate prior art materials are inferior in their applicablilty because the highest solid loadings (up to about 91% w/w) could be obtained with materials embodying the present invention and such maximum solids loading can be used to maximise energetic performance.

Qualitative assessment was made of rolled sheets of the two types of material being compared. Table 12 as follows shows the results obtained; this confirms the excellent physical properties at ambient temperature of materials embodying the present invention compared with the prior art materials.

TABLE 12

| QUALITATIVE COMPARISON OF EXPLOSIVE FORMULATIONS | |
|---|---|
| EXPLOSIVE COMPOSITION REFERENCE | QUALITY OF ROLLED SHEET |
| E13 | Soft, extensible. Very flexible. Some elastic memory. |
| E14 | Hard and tough. Flexible. Little elastic memory. |
| E18 | Tough and strong. But very flexible. Some elastic memory. Excellent handling properties |
| DNE 1 | Soft, smooth and floppy. Low strength. Cracks and breaks easily. |
| DNE 2 | Soft and extensible. Some flexibility but tends to be friable. Low strength. |
| DNE 3 | Very soft & extensible. Stretchy and friable. Cracks extensively when flexed. |

Comments in the second column of Table 12 apply to inspection of hand rolled sheets of thickness 3 mm to 5 mm.

Explosive sheets of materials embodying the present invention are highly flexible and durable with good extensibility. Characteristics can be adjusted to suit requirements from lower strength but very extensible materials, to tough high strength explosives. Prior art materials of the class as covered in UKP 1,554,636 tend to be low strength and rather less flexible, fracturing readily when handled.

In extrusion trials, selecting optimum extrusion conditions for each candidate, explosives compositions embodying present invention gave rapid extrusion of high quality charges. Explosives based on the prior art materials of UKP 1,554,636 would not extrude easily and results were poor. Prior art materials DNE1 and DNE2 give brittle friable extrudates which was produced very slowly at higher temperature and pressure than explosives of the present invention. Composition DNE 3 undesirably succeeded in clogging the extrusion die.

In conclusion, energetic formulations embodying the present invention especially for explosives demonstrate physical properties more favourable for the intended applications than corresponding formulations of the class based on the disclosure of the prior art described in UKP 1,554,636. The latter are relatively low strength friable materials and may present processing and handling difficulties. Those embodying the present invention are highly flexible and extensible with acceptable tensile strength. They are easily processed and the formulation may be adapted to satisfy specific requirements for performance or physical properties. They can be used to give energetic compositions with higher solids loadings and therefore higher energetic performance.

Examples of formulations further illustrating use of energetic materials embodying the present invention for various applications are Examples 1 to 6 given in Tables 13 to 18 as follows. The materials in each case are suitable for use as the energetic material of each application as stated.

TABLE 13

| EXAMPLE 1 GAS GENERATOR MATERIAL | |
|---|---|
| INGREDIENT | % w/w |
| RDX | 78 |
| Oxamide | 10 |
| Binder B17 (specified above) | 12 |

TABLE 14

| EXAMPLE 2 GAS GENERATOR MATERIAL | |
|---|---|
| INGREDIENT | % w/w |
| RDX | 65 |
| Ethyl Cellulose | 10 |
| Binder B21 | 25 |

TABLE 15

| EXAMPLE 3 GUN PROPELLANT MATERIAL | |
|---|---|
| INGREDIENT | % w/w |
| RDX | 82.0 |
| Nitrocellulose | 4.0 |
| CAB (Cellulose acetate butyrate) | 3.5 |
| Carbamite | 0.5 |
| Binder B19 | 10.0 |

TABLE 16

| EXAMPLE 4 GUN PROPELLANT MATERIAL | |
|---|---|
| INGREDIENT | % w/w |
| RDX | 82.5 |
| Nitrocellulose | 4.0 |
| CAB (Cellulose acetate butyrate) | 3.0 |
| DBP | 3.0 |
| Carbamite | 0.5 |
| Binder B17 | 7.0 |

TABLE 17

| EXAMPLE 5 SHAPED CHARGE WARHEAD FILLING MATERIAL | |
|---|---|
| INGREDIENT | % w/w |
| HMX | 88 |
| Binder B17 | 12 |

TABLE 18

| EXAMPLE 6 CRATERING AND OBSTACLE CLEARANCE MATERIAL | |
|---|---|
| INGREDIENT | % w/w |
| RDX | 63 |
| Aluminum Powder | 25 |
| Binder B19 | 12 |

Example 6 illustrates the addition of a metallic fuel to the oxidisers employed in energetic materials embodying the present invention. In general, such fuel eg. aluminium or other metallic powder, may be added in loadings up to 50% by weight, eg. loadings of 10% to 30% by weight of metallic fuel based upon the overall composition weight.

What is claimed is:

1. A thermoplastic bonded energetic material which comprises:

Component A: an energetic filler material; and

Component B: a polymeric binder for the energetic filler material;

wherein the ratio of the weight of Component A present to the weight of Component B present in the composition is in the inclusive range from 1:10 to 199:1 and wherein Component B comprises an intimate mixture of Ingredients 1 and 2 as follows:

Ingredient 1: a copolymer of ethylene and vinyl acetate;

Ingredient 2: a copolymer of butadiene and acrylonitrile; the ratio of the weight of Ingredient 1 present to the weight of Ingredient 2 present in Component B being in the inclusive range from 1:10 to 10:1.

2. A material as claimed in claim 1 and wherein the softening point of Component B is greater than 60° C.

3. A material as claimed in claim 1 and wherein Ingredient 2 is a material which per se is in the form of a liquid having a viscosity greater than 50 cst when measured at a temperature of 20° C. and a molecular weight in the inclusive range 2000 to 5000.

4. A material as claimed in claim 1 and which is in the form of a consolidated rubbery mass, the energetic filler Component A being a particulate solid being embedded in the binder Component B.

5. A material as claimed in claim 1 and which also includes one or more other additives which comprise in total not more than 10 percent by weight of Component B.

6. A material as claimed in claim 1 and wherein Component A comprises from 50 to 75 percent by weight of Ingredient 1 and from 25 to 50 percent weight of Ingredient 2.

7. A material as claimed in claim 1 and wherein the Ingredient 1 present in Component B has a vinyl acetate content of from 33 to 60 percent inclusive.

8. A material as claimed in claim 1 and in which the Ingredient 2 present in Component B has a bound acrylonitrile content in the inclusive range 10 to 30 percent by weight.

9. A material as claimed in claim 1 and wherein the Ingredient 2 contained in Component B is provided by a mixture of different compounds having different acrylonitrile contents.

10. A material as claimed in claim 1 and which comprises a plastic bonded explosive in which the binder forms between 0.5 and 30 percent by weight and the energetic filler forms between 99.5 and 70 percent by weight of the material.

11. A material as claimed in claim 10 and wherein one or more metallic fuels is included in the energetic filler to fuel the exothermic reaction of the oxidation of the energetic material, the metallic fuel forming up to 50 percent by weight of the energetic filler.

12. A material as claimed in claim 1 and which comprises a gun propellant, the content of the energetic filler being in the range 70 to 90 percent by weight of the binder/filler mixture.

13. A material as claimed in claim 12 and wherein the binder comprises in addition to the blend of Ingredients 1 and 2 a cellulosic material forming from 30 to 70 percent of the binder.

14. An energetic material as claimed in claim 1 and which comprises a gas generator material comprising from 45% to 65% by weight energetic filler optionally together with a surface burning rate inhibitor.

15. An energetic material as claimed in claim 1 and which comprises a rocket propellant composition which includes ammonium perchlorate forming 20 to 90 percent by weight of the energetic filler, together with aluminium as fuel forming from 5 to 50 percent by weight of its mixture with energetic filler, the binder forming from 5 to 30 percent by weight of the composition.

16. An energetic material as claimed in claim 1 and wherein the energetic filler comprises an inorganic nitrate or perchlorate of ammonium, barium or strontium forming 20 to 80 percent by weight of the energetic filler, together with a metallic fuel forming 5 to 60 percent by weight of the filler, the binder comprising 5 to 30 percent by weight of the overall composition.

17. An energetic material according to claim 1 and which is a plastic bonded explosive which comprises the following components (in percentage parts by weight):

RDX: 80–99.5 percent, binder: 20–0.5 percent.

18. An energetic material as claimed in claim 17 and wherein the binder comprises 60 to 75 percent Ingredient 1 at least 25 percent of which is a polymer having a 45% by weight vinyl acetate content; 25 to 50 percent Ingredient 2 and 0 to 1 percent antioxidant, the overall percentages (excluding further optional additives) adding to 100.

* * * * *